US005450971A

United States Patent [19]

Boron et al.

[11] Patent Number: 5,450,971

[45] Date of Patent: Sep. 19, 1995

[54] ADJUSTABLE SHELF SUPPORT STRUCTURE

[75] Inventors: Andrew J. Boron, Harbour; Donald J. Miller, Jr., Belleville, both of Ill.; Keith Harbour, Florissant, all of Ill.

[73] Assignee: Paul Flum Ideas, Inc., St. Louis, Mo.

[21] Appl. No.: 320,735

[22] Filed: Oct. 11, 1994

[51] Int. Cl.[6] ..... A47F 5/00

[52] U.S. Cl. ..... 211/134; 108/107; 211/153; 211/175; 211/187

[58] Field of Search ..... 108/162, 107, 137, 144; 211/59.2, 175, 181, 187, 153, 184

[56] References Cited

U.S. PATENT DOCUMENTS

| | | | |
|---|---|---|---|
| 3,998,170 | 12/1976 | Gordon | 211/181 X |
| 4,267,931 | 5/1981 | Belotta | 211/181 X |
| 4,331,243 | 5/1982 | Doll | 211/59.2 |
| 4,416,380 | 11/1983 | Flum . | |
| 4,444,320 | 4/1984 | Chap | 211/134 |
| 4,478,337 | 10/1984 | Flum . | |
| 4,553,523 | 11/1985 | Stohren | 211/175 X |
| 4,593,823 | 6/1986 | Fershko et al. | 211/49.1 |
| 4,690,287 | 9/1987 | Fershko et al. | 211/49.1 |
| 4,801,025 | 1/1989 | Flum et al. | 211/128 |
| 5,197,609 | 3/1993 | Siegel | 211/175 X |

*Primary Examiner*—Robert W. Gibson, Jr.

*Attorney, Agent, or Firm*—Haverstock, Garrett & Roberts

[57] ABSTRACT

An adjustable shelf support structure adaptable for use in combination with existing refrigerated display coolers and other types of product merchandising display equipment including first and second members which are telescopingly engageable with each other such that the first and second members can be moved relative to each other to change the overall width of the support structure, the first and second members further including a mechanism for varying the effective length of the opposed side portions of the support structure so as to change the overall depth thereof, the first and second members when engaged with each other being capable of both width and depth adjustment to accommodate the varying width and depth dimensions associated with existing product merchandising display equipment. The present shelf support structure also includes a plurality of hook members which are specifically designed to engage both the shelf support structure and the upright support members commonly associated with existing display equipment, the hook members being selectively engageable with such upright support members at various intermediate locations therealong so as to orient the present support structure in either a substantially flat horizontal position or in an inclined position for gravity feed operations.

18 Claims, 5 Drawing Sheets

ADJUSTABLE SHELF SUPPORT STRUCTURE

The present invention relates to a shelf support structure for supporting product merchandising units and the like and, more particularly, to an adjustable shelf support structure primarily designed for use in certain types of existing refrigerated display coolers and other types of cold vaults, the present support structure being mountable or suspendable within such existing coolers in spaced apart relationship either one above the other, or between existing shelving associated with such coolers, so as to provide a multi-tier arrangement upon which product merchandising units can be placed to merchandise shelved products therefrom. The present support structure increases and maximizes available shelf capacity, particularly the vertical space between existing shelves; it is specifically designed for use in place of existing two-tier product merchandising units which are sometimes awkward and cumbersome to handle and position; it includes both width and depth adjustment means; and it can be mounted in either a flat horizontal position or in an inclined position for gravity feeding products positioned thereon. Although the present unit is ideally suited and primarily designed for use in refrigerated display cases commonly utilized in supermarkets, convenience stores, and other food and beverage outlets, it is likewise adaptable for use in many other display shelf applications such as a wide variety of free-standing visi-coolers commonly employed by beverage manufacturers.

BACKGROUND OF THE INVENTION

A wide variety of display devices have been designed and manufactured for use in merchandising shelved products to consumers. One of the major problems associated with storing and displaying shelved products for sale to consumers and, in particular, shelved products requiring refrigeration in display coolers and other types of cold vaults, is the inefficient use of available shelf space, particularly, the vertical space available between adjacent shelves. Although various product display devices have been designed to alleviate this particular problem such as the two-tier systems disclosed in U.S. Pat. Nos. 4,593,823 and 4,801,025, such units are not always adaptable for use within refrigerated display coolers since the spatial dimensions associated with existing coolers vary from one refrigerated unit to the next. Also, such prior art two-tier shelving units are tied to each other and such systems are not always easily maneuverable within a particular cold vault, particularly, when such units are loaded with product. The relative stability of existing two-tier systems is also of some concern particularly in light of the advent of the larger product containers commonly used, for example, in the soft drink industry. The wide use of multiple product container heights also requires the height between vertically spaced shelving to be adjustable to accommodate such product height differences, a feature not always possible with existing two-tier systems. It is therefore a principal aim of the present invention to obviate many of the disadvantages and shortcomings associated with the known prior art devices and to provide a shelf support structure which is compatible for use with many of the existing refrigerated display coolers, which is both width and depth adjustable, and which enables a user to form a multi-tier shelf system within a refrigerated cooler thereby maximizing usage of the vertical space available between adjacent product merchandising units.

SUMMARY OF THE INVENTION

The present shelf support structure has overcome many of the disadvantages and short comings associated with the known two-tier product display shelf devices and teaches the construction and operation of an adjustable support assembly which is adaptable for use with existing refrigerated shelf cooler equipment, either in a flat horizontal position or in an inclined position for gravity feed operations. The present support structure can be used for supporting product merchandising units designed to display both chilled and unchilled products and is particularly well suited for holding and supporting a wide variety of known product merchandising units specifically designed to merchandise and display a wide variety of soft drink type products including fruit juices, dairy products and the like, which product display devices are commonly used in supermarkets, convenient stores, and a multitude of other food and beverage outlets. The present shelf support structure is preferably of an open grid rod and tube-type construction and includes first and second relatively movable members which, in combination, define a substantially horizontal grid structure capable of supporting a wide variety of product merchandising units thereupon. The first and second members are telescopingly engageable with each other in such a manner that the overall width of the structure is easily adjustable so as to accommodate varying shelf widths associated with the wide variety of known refrigerated coolers and other shelving equipment. The rod members forming the opposed side portions of the support structure each likewise include adjustment means for enabling the overall length of each such rod member to be adjusted to accommodate varying shelf or cooler depths. The very fact that the present support structure is both width and depth adjustable greatly facilitates its use in a multitude of different merchandising applications.

Many known refrigerated cooler assemblies such as the ARDCO, ANTHONY and STYLELINE systems are supported by means that are connected between the various shelves associated therewith and upright support members which include slots, notches, hooks or other types of openings or similar attachment means formed therein. Since the present support structure is specifically designed for use with such known cooler systems, it includes a plurality of hook members adaptable for cooperatively engaging the hook or opening means associated with the respective upright support members utilized in the particular cold vault. Each hook member is slidably movable along at least a portion of one of the opposed side rod members, one hook member being located in the vicinity of each of the four respective corners of the present support structure. Since each hook member is slidably movable on its associated rod member, each hook member can be easily manipulated to a position adjacent a respective upright support member associated with a particular refrigerated cooler or other shelf structure for easy engagement therewith. These hook members therefore enable the present support structure to be easily positioned and attached to the upright support members of any particular refrigerated cooler at any intermediate position therealong including between shelf members already associated with the particular cooler assembly. Also, importantly, since each upright cooler support member includes a plurality of vertically spaced hooks, openings, or other similar attachment means therein, the present hook members can be engaged with the upright cooler support members so as to achieve either a flat horizontal position or an inclined position for gravity feed type operations, the inclined orientation being achieved by simply elevating the rear portion of the present support structure to achieve an inclination such that when a product merchandising unit is positioned thereon, products positioned within such merchandising unit will slide forward under the force of gravity towards the front portion of such unit. The present adjustable shelf support structure can likewise be easily converted for use with known visi-cooler applications.

Because of the adjustability of the present support structure, it can be used to hold and support product merchandising units specifically designed to merchandise specific types of products such as, in the soft drink industry, soft drink products packaged in cans, or in 12 ounce, 16 ounce, 20 ounce, 1 liter, 2 liter, or 3 liter plastic or glass containers. This capability maximizes the use of the present shelf support structure in most existing refrigerated cooler applications and obviates the need for utilizing a plurality of different merchandising units to both accommodate different sizes and styles of product containers and to achieve different product display configurations. Because of its versatility and ability to achieve any selected depth and width, the present shelf support structure represents a one-inventory solution to a user enabling such user to organize and configure any particular refrigerated cooler to meet his/her specific needs and space requirements. Also, importantly, use of the present adjustable shelf support structure is extremely cost effective because such support structure is adaptable for use with existing shelving equipment; such support structure requires no additional parts, tools, or other means for interconnecting the same into a particular refrigerated cooler; and such support structures can be utilized either in a flat horizontal orientation or in an inclined orientation for gravity feed operations.

It is therefore a principal object of the present invention to provide a shelf support structure adaptable for use with existing shelving systems commonly utilized in convenience stores, gas mini-marts and other merchandising centers including shelf systems associated with refrigerated display coolers and visi-coolers.

Another object is to provide an adjustable shelf support structure which more effectively utilizes available merchandising areas associated with refrigerated display coolers.

Another object is to provide a shelf support structure wherein both the depth and width of the support assembly is adjustable to increase the overall size thereof.

Another object is to provide a more efficient and simpler means for achieving a stacking arrangement without interaction with any other shelf to provide increased packout within a given amount of merchandising space.

Another object is to teach the construction and operation of a shelf support structure which can be utilized to achieve a multi-tier display arrangement within existing refrigerated coolers and other known shelving systems.

Another object is to provide a shelf support structure which reduces and saves the vertical space between shelved products in certain display applications such as existing refrigerated coolers and other known shelving systems.

These and other objects and advantages of the present invention will become apparent to those skilled in the art after considering the following detail specification which discloses a preferred embodiment of the present support structure in conjunction with the accompanying drawings wherein:

DETAILED DESCRIPTION OF THE INVENTION

Figure 1:
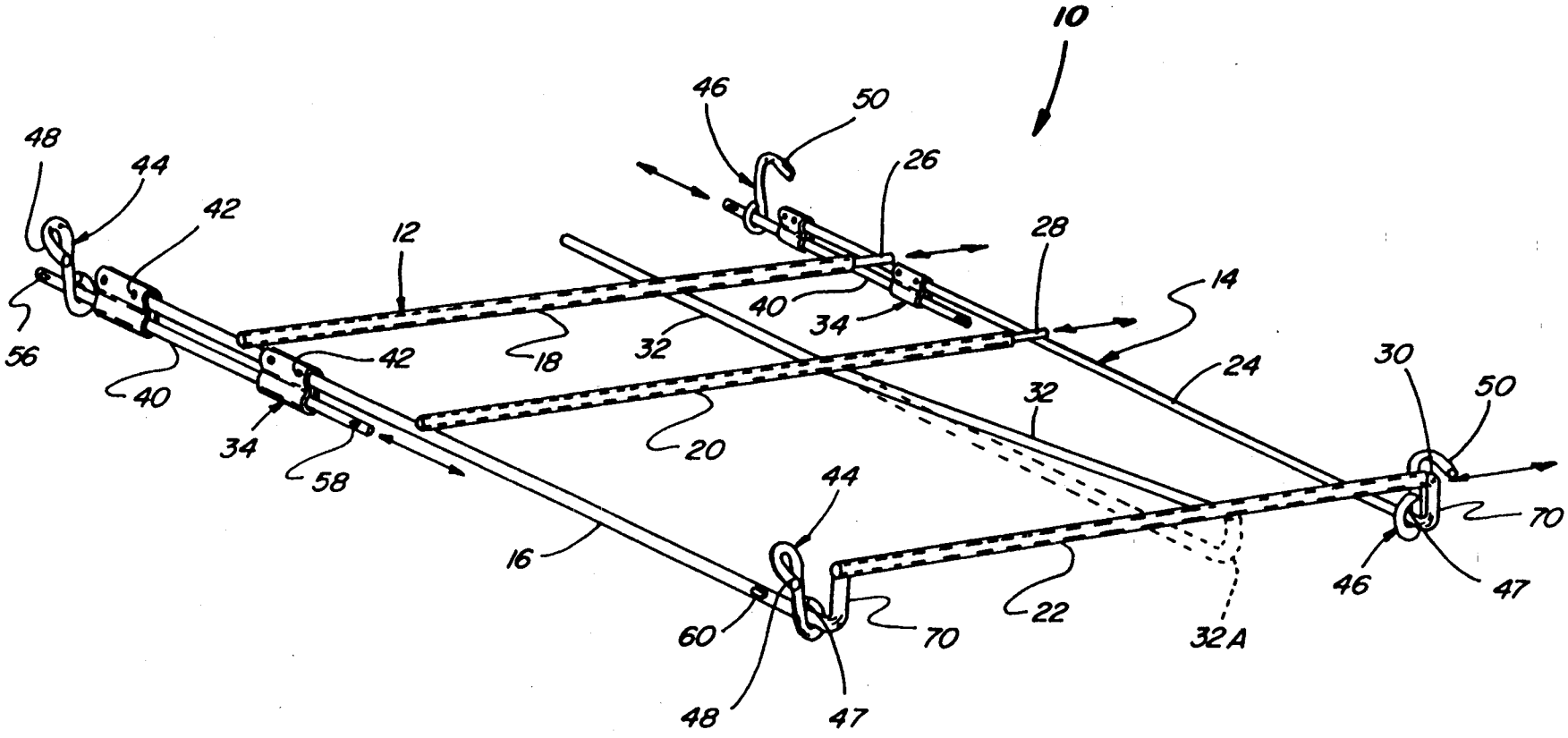
FIG. 1 is a perspective view of the present adjustable shelf support structure constructed according to the teachings of the present invention, the present support structure being shown in its fully collapsed or unexpanded position.
Figure 2:
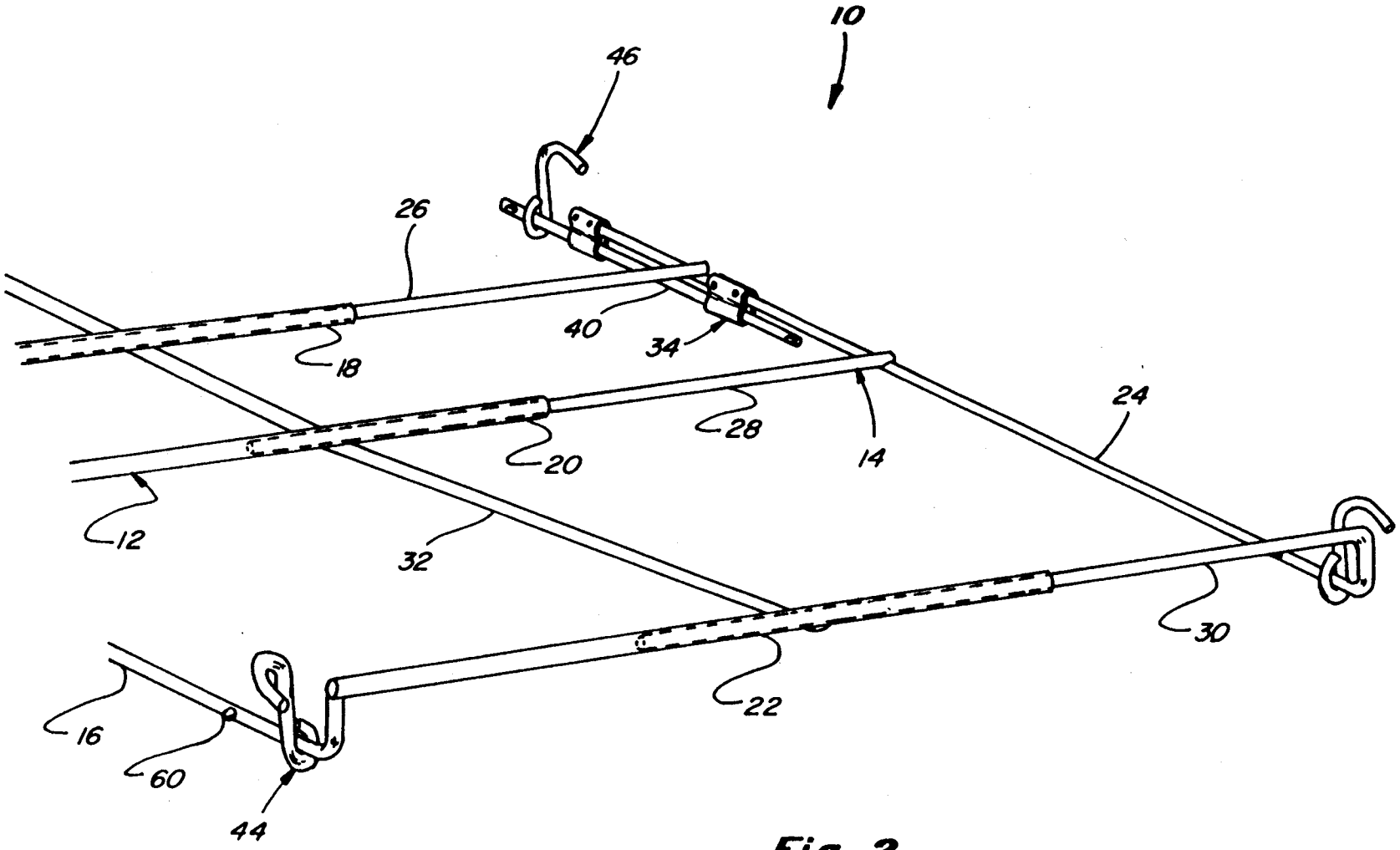
FIG. 2 is a partial perspective view similar to FIG. 1 showing the present shelf support structure in an expanded position.

Referring to the drawings more particularly by reference numbers wherein like numerals refer to like parts, number 10 in FIG. 1 identifies an adjustable shelf support structure constructed according to the teachings of the present invention. The shelf structure 10 includes members 12 and 14 which, in combination, define a substantially horizontal open grid wire, tube or rod type structure capable of supporting a wide variety of product merchandising units when placed thereupon. The members 12 and 14 are telescopingly engageable with each other as best shown in FIGS. 1 and 2 such that the overall width of the structure 10 can be easily adjustable to accommodate any shelf width. The member 12 includes a rod member 16 which comprises one side portion of the overall structure 10 as well as a plurality of tubular type members 18, 20 and 22, the members 18–22 being oriented substantially perpendicular to rod member 16 as best shown in FIGS. 1 and 2. The members 18, 20 and 22 form a major portion of the support surface upon which other product merchandising units will be placed for merchandising products therefrom.

The member 14 is constructed substantially similar to member 12 and includes a rod member 24 which forms the opposed side portion of the overall structure 10 as best shown in FIGS. 1 and 2. Like the member 16, the member 14 likewise includes a plurality of rod members 26, 28 and 30 which are oriented substantially perpendicular to rod member 24 and, importantly, are positioned and located so as to be slidably insertable within the corresponding tubular members 18, 20 and 22 as shown in FIGS. 1 and 2. When positioned in telescoping relationship with each other, the tubular members 18–22 lie in alignment with the rod members 26–30 to form continuations thereof, the members 12 and 14 being slidably movable relative to each other to adjust the overall width of the structure 10. This telescoping feature allows a user to conveniently adjust the overall width of the structure 10 between the respective side portions 16 and 24 to accommodate varying shelf widths commonly associated with a wide variety of known shelving equipment including refrigerated coolers. In this regard, FIG. 1 illustrates the present shelf structure 10 in its fully collapsed or unexpanded position whereas FIG. 2 illustrates the present shelf structure 10 in an expanded width position.

The member 12 may also include an additional rod support member 32 positioned intermediate the respective side members 16 and 24 as best shown in FIG. 1 so as to provide additional support and stability to the overall structure 10, particularly, when the member 14 is moved to an expanded width position. The rod member 32 is preferably located towards the free end portion of the tubular members 18, 20 and 22 as shown for obvious reasons, although any plurality of additional support rod members 32 may be spacedly arranged between the member 16 and the free end portions of the tubular members 18–22 depending upon the size and weight of the particular product merchandising unit placed thereupon as well as the size and weight of the particular products to be merchandised therefrom. In this regard, it is also recognized that any plurality of tubular members 20 and corresponding rod members 28 may likewise be positioned and located in spaced relationship between the front and rear portions of the overall shelf structure 10 so as to provide an adequate support surface for the product merchandising unit placed thereupon again depending upon the type and weight of the products to be merchandised therefrom. Regardless of the total number of cooperatively engageable cross members associated with the members 12 and 14 such as the members 18–22 and 26–30, the tubular members such as the members 18–22 must be adaptable to slidably receive and telescopingly cooperate with their corresponding rod members such as the members 26–30 as explained above.

Figure 3:
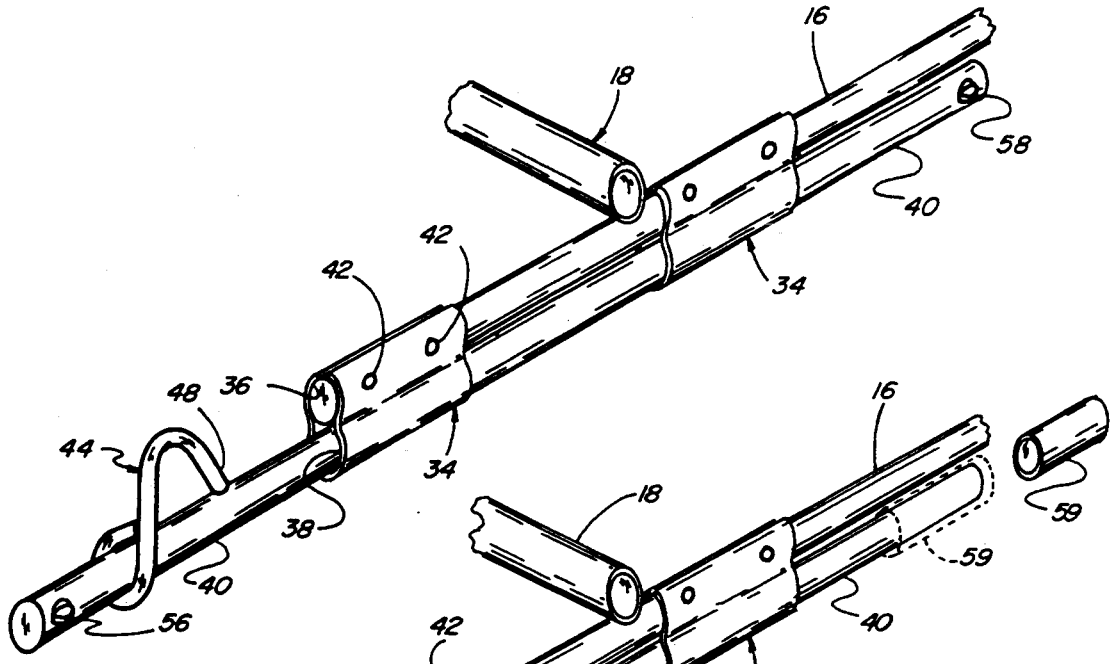
FIG. 3 is a partial perspective view of the left rear corner of the support structure shown in FIG. 1 illustrating the adjustment means for varying the overall depth of the present support structure.

Each of the rod members 16 and 24 forming the opposed side portions of the shelf structure 10 likewise include adjustment means for enabling the overall length of each such rod member to be adjusted to accommodate varying shelf or cooler depths. As best shown in FIGS. 1 and 3, the rod members 16 and 24 each include a pair of bracket members 34, each bracket member including a pair of openings or channels 36 and 38 each adaptable for receiving a rod-type member as best illustrated in FIG. 3. More particularly, the bracket opening or channel 36 is shaped and dimensioned so as to cooperatively receive the side rod members 16 and 24 and the bracket opening or channel 38 is specifically designed to cooperatively receive an extension rod member 40 as best shown in FIG. 3. The bracket members 34 are fixedly attached to the side rod members 16 and 24 via any suitable means such as by spot welding the same to their respective rod members as shown at 42. The extension rod member 40 is slidably movable within each bracket opening 38 so as to increase the overall depth or length of the structure 10 from front to rear to accommodate varying shelf or cooler depths. The overall length of the extension rod member 40 will depend upon the amount of additional shelf depth extension required for any particular application. As best shown in FIGS. 1 and 2, each respective pair of bracket members 34 are fixedly attached to the side rod members 16 and 24 so as to straddle the rearwardmost cross members 18 and 26. Although this particular arrangement of respective pairs of bracket members 34 provides a more stable arrangement for free movement of the extension member 40 therewithin, depending upon the overall length of the rod member 40, a single bracket 34 may likewise be suitable and may provide adequate stability depending upon the weight of the products placed thereupon. It is also recognized and anticipated that other bracket arrangements as well as other bracket configurations may likewise be utilized to accomplish the shelf depth adjustment capability of the present assembly.

Figure 4:
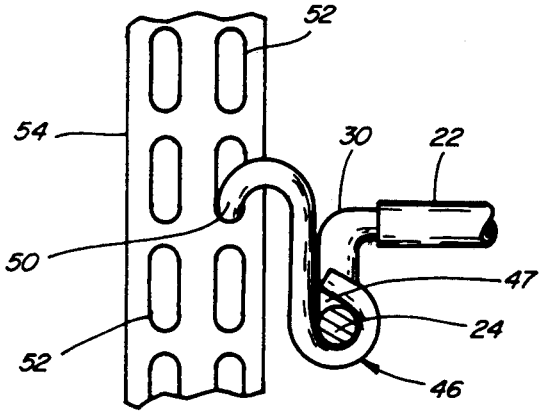
FIG. 4 is a partial rear elevational view of the right front corner of the present support structure illustrating engagement of one of the present hook members with a typical upright support member associated with many known refrigerated cooler assemblies.
Figure 5:
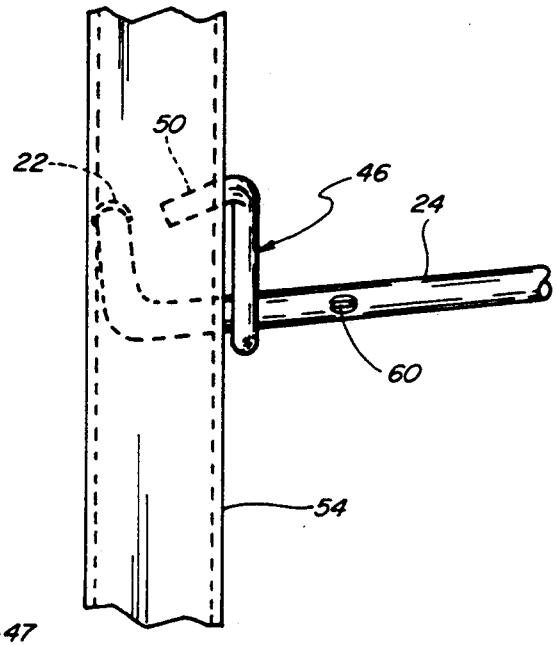
FIG. 5 is a partial right side elevational view substantially similar to FIG. 4.

Since the present shelf support structure 10 is specifically designed for use with known refrigerated cooler systems such as the ARDCO, ANTHONY and STYLELINE systems, it includes a plurality of hook members 44 and 46 adaptable for cooperatively engaging the respective upright support members associated with such known equipment. Each hook member 44 and 46 includes an eyelet portion 47 as best shown in FIG. 4 which is sized and dimensioned so as to cooperatively receive therethrough any one of the rod members 16, 24 and 40. Each hook member is therefore slidably movable along at least a portion of the particular rod member to which it is attached, one hook member being located in the vicinity of each of the respective four comers of the overall support structure 10 as best illustrated in FIG. 1. Each hook member 44 and 46 likewise includes an angularly related portion 48 and 50 respectively, which portions 48 and 50 are specifically designed to engage any one of a plurality of vertically spaced hooks, openings or other similar attachment means commonly associated with the upright support members utilized in many of the known cooler systems and other shelving equipment such as the vertically spaced openings 52 associated with the upright support member 54 illustrated in FIGS. 4 and 5. The upright support member 54 is typical of the type of vertical support means utilized in many of the known load carrying rack assemblies such as the ARDCO, ANTHONY and STYLELINE systems. Since each hook member is slidably movable on its associated rod member, each hook member 44 and 46 can be easily manipulated to a position adjacent a respective upright support member 54 (FIGS. 4 and 5) so as to enable the angularly related portion 48 or 50 associated respectively therewith to be positioned extending through one of the openings 52 as best illustrated in FIG. 4. It is the angularly related hook portions 48 and 50 which actually support the structure 10 in a particular orientation when engaged with the openings 52 formed in the upright support members 54.

It is important to recognize that the hook members 44 are mirror images of the hook members 46. This is true because the angularly related portions 48 and 50 of hook members 44 and 46 must extend laterally outwardly away from the overall structure 10 so as to be able to engage the respective upright support members 54 associated with a particular display unit. Also, since the rod members 40 are positioned below the rod members 16 and 24, the hook members engaged with the members 40 must be slightly longer in overall height as compared with the forwardmost hook members in order to maintain a substantially flat horizontal orientation when all four hook members are engaged with respective openings 52 located in the same horizontal plane. The present hook members 44 and 46 enable the present support structure 10 to be easily positioned and attached to the upright support members of any particular refrigerated cooler or other shelf unit at any intermediate position therealong including between shelf members already associated with the particular cooler or shelf assembly. This is best illustrated in FIGS. 6 and 7 as will be hereinafter explained.

Since the hook members engaged with the rod members 40 are free to slide therealong, each rod member 40 further includes stop means 56 and 58 at each opposite end portion thereof, the stop means 56 preventing the respective hook members 44 and 46 from becoming disengaged from the rod members 40 while the stop means 58 prevents the rod members 40 from becoming disengaged with the bracket members 34 when fully extended. Similarly, each of the rod members 16 and 24 may likewise include forward stop means 60 positioned so as to limit travel of the forwardmost hook members within a specified range between stop means 60 and the forwardmost members 22 and 30. The respective stop means 56, 58 and 60 can comprise a bead or projection formed on the associated rod member, or such stop means can be formed by swaging or otherwise deforming the associated rod member at the appropriate location therealong so as to prevent the eyelet portion 47 of each respective hook member from passing such location. Other suitable stop means are likewise anticipated and contemplated.

Figure 3A:
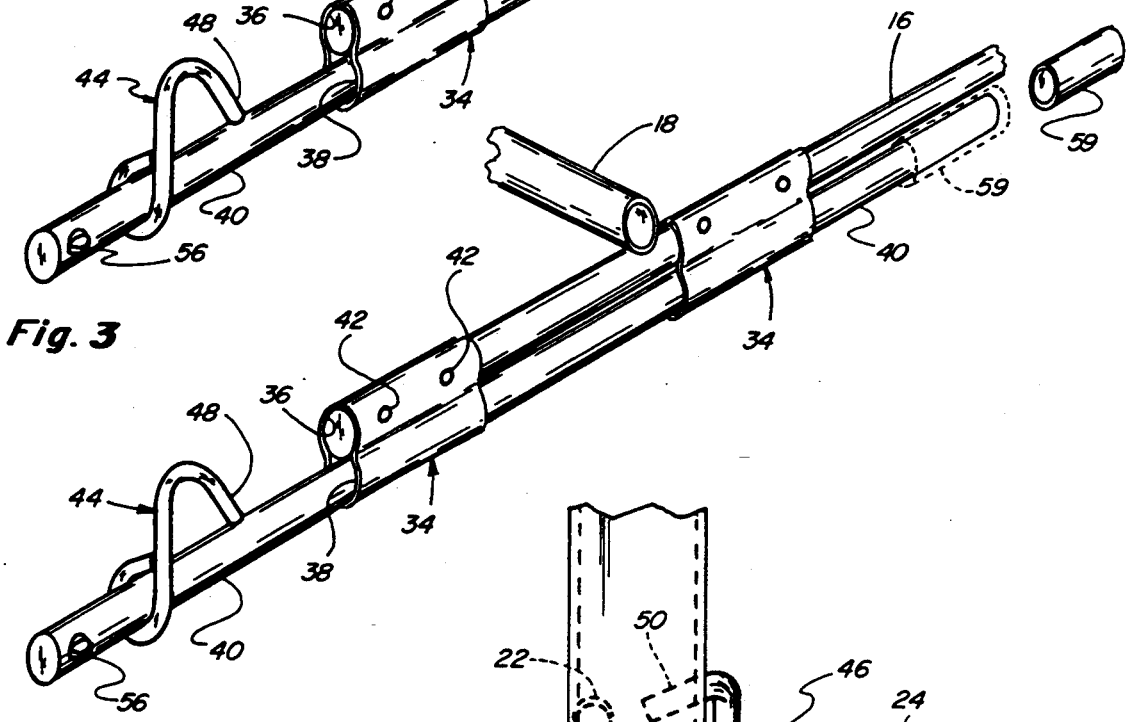
FIG. 3A is a partial perspective view similar to FIG. 3 illustrating the use of removable stop means in conjunction with one end portion of the adjustment means shown in FIG. 3.

In certain display applications, depending upon the orientation of the spaced openings 52 or other attachment means commonly associated with the upright support members utilized in many of the known cooler systems and other shelving equipment, it may be necessary to re-orient the hook members 44 and 46 associated with the rod members 40 so as to properly position the angularly related hook portions 48 and 50 for engagement with the upright support members. In this situation, it will be necessary to remove the hook members 44 and 46 from their respective rod members 40 and rotate the same 180° prior to reattachment thereto. In order to accomplish this task, removable stop means in the form of a cap member 59 is used in place of the stop means 58 as best shown in FIG. 3A. The cap member 59 is slidably engageable with the one end portion of each respective rod member 40 and, when engaged with such rod members 40, functions identically to stop means 58 in that it prevents the rod members 40 from becoming disengaged with the bracket members 34 when fully extended. Importantly, in total contrast to use of the stop means 58, the stop member 59 is slidably removable from the end portion of each respective rod member 40 and, when so removed, allows each rod member 40 to be slidably removed from their respective bracket members 34 thereby enabling the hook members 44 and 46 to be removed therefrom. Once the hook members 44 and 46 are reattached to their respective rod members 40, such rod members are slidably re-engaged with their respective bracket members 34 and the cap member 59 is then re-engaged with the rod members 40. Use of the removable stop means 59 also affords the capability of easily changing and/or replacing the hook members 44 and 46 at will depending upon the particular application involved or normal wear and tear on such hook members, and it also allows a user to change and/or replace the individual rod members 40 for similar reasons. It is also anticipated and contemplated that removable stop means other than the cap member 59 may likewise be utilized in the practice of the present invention.

Figure 7:
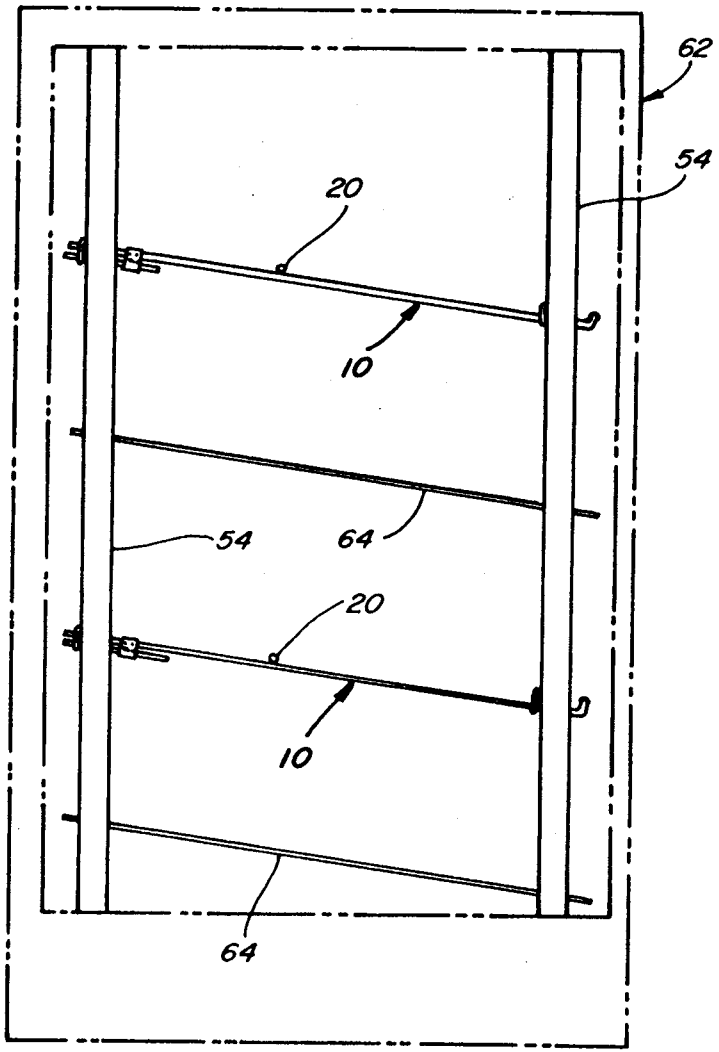
FIG. 7 is a side elevational view showing the present support structures mounted in a typical refrigerated cooler assembly in an inclined orientation for gravity feed operation.
Figure 6:
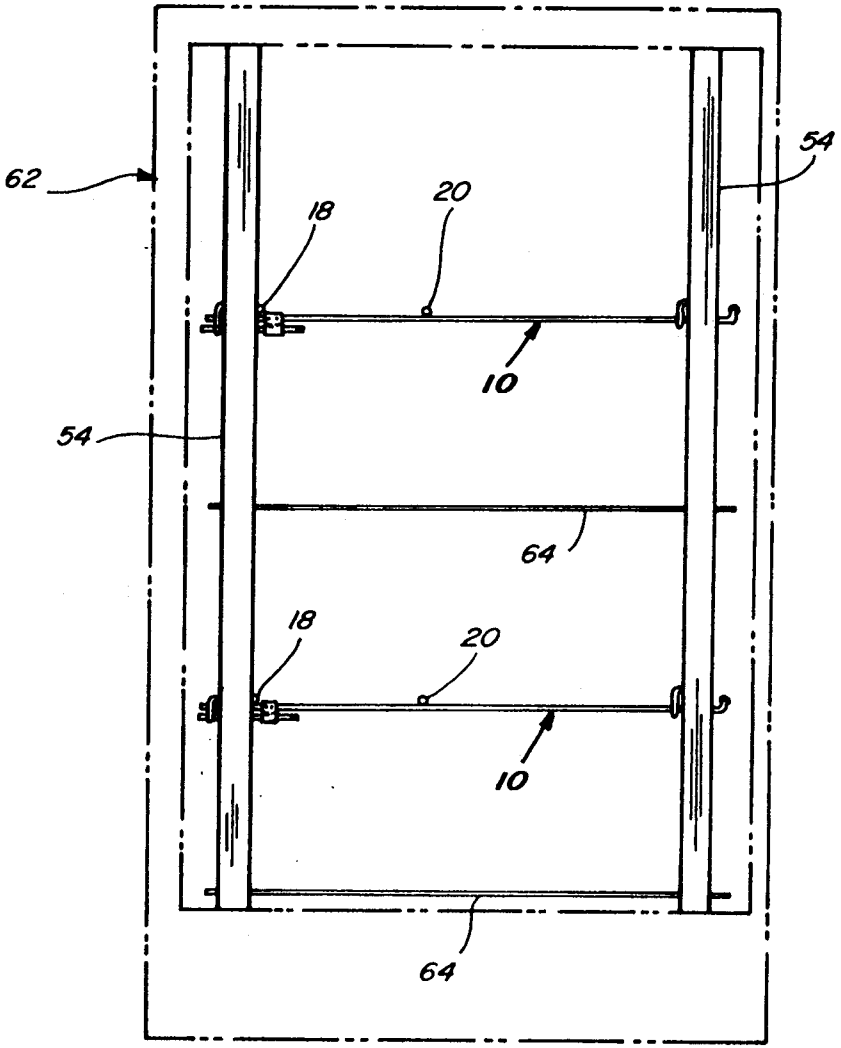
FIG. 6 is a side elevational view showing the present support structures mounted in a typical refrigerated cooler assembly in a substantially flat horizontal orientation.

FIGS. 6 and 7 illustrate typical applications of the present shelf structure 10 in a typical refrigerated cooler. More particularly, FIG. 6 discloses a side elevational view of a conventional refrigerated display cooler 62 having upright support members 54 associated therewith as well as some shelf members 64 which are selectively positionable at various intermediate locations along the length of the upright support members 54. In the particular display arrangement illustrated in FIG. 6, the shelf members 64 are oriented in a substantially fiat horizontal position and the present shelf structures 10 are positioned and attached therebetween to the upright support members 54 as illustrated. Attachment of the present shelf structures 10 to the upright members 54 is accomplished by slidably moving the members 12 and 14 relative to each other in order to achieve the desired width between the upright members 54 and the extension rod members 40 are slidably moved within the bracket members 34 in order to achieve the desired depth between the fore and aft support members 54. The hook members 44 and 46 are thereafter slidably positioned on their associated rod member so as to lie adjacent to one of the upright support members 54. Each hook member 44 and 46 is then engaged with the appropriate opening 52 or other similar means associated with the adjacent upright support member 54 as previously explained with reference to FIGS. 4 and 5. Any plurality of the present shelf structures 10 may be positioned between the existing shelf members 64 associated with a particular refrigerated cooler or other shelving equipment such as the unit 62 depending upon the space between such existing shelf members as well as the overall height of the various products to be merchandised therewithin. Once the present shelf structures 10 are positioned within a particular unit, a wide variety of different types of product merchandising units can be supported thereon for displaying products to consumers. The very fact that the present support structures 10 are both width and depth adjustable greatly facilitates their use in a multitude of different types of refrigerated coolers as well as other shelving and display equipment since the present structures 10 can be expanded and contracted to accommodate the varying width and depth dimensions associated with the known units. In fact, depending upon the ease with which the shelf members 64 can be re-positioned within a particular shelving display, the shelf members 64 which typically come with many of the known display units can be removed from such units and replaced with the more easily maneuverable and attachable shelf support structures 10. This represents a one-inventory solution to a user enabling such user to organize and configure any particular refrigerated cooler or other display unit to meet his/her specific needs and space requirements thereby significantly reducing and minimizing the vertical space between shelved products in a particular display application.

FIG. 7 illustrates use of the present shelf support structures 10 in a gravity feed application. Certain known types of shelving systems such as the ARDCO, ANTHONY and STYLELINE systems are particularly adaptable for conversion to a gravity feed type operation by simply elevating the rear portion of the shelf members associated therewith to achieve an inclination such that when product merchandising units are positioned thereon, rows of products positioned on the respective merchandising units will slide under the force of gravity towards the front portion thereof in a smooth and steady manner and without toppling over. In similar fashion, the present shelf support structures 10 can likewise be easily manipulated and attached to the upright support members 54 so as to achieve an inclined position for gravity feed type operations, the inclined orientation being achieved by simply elevating the rear portion of the support structures 10 to achieve the desired inclination. Like the display arrangement disclosed in FIG. 6, the present support structures 10 can be positioned and attached to the upright support members 54 in a gravity feed orientation at any intermediate location therealong including between existing shelf members 64 as illustrated. Use of the hook members 44 and 46 located adjacent the rear corners of the respective support structures 10 in conjunction with the adjacent upright support members 54 enables a user to easily adjust the elevation of the rear portion of each of the support structures 10 to achieve the proper inclination such that when product merchandising units are positioned thereon, products placed in such merchandising units will automatically gravity feed towards the front portion thereof.

Figure 8:
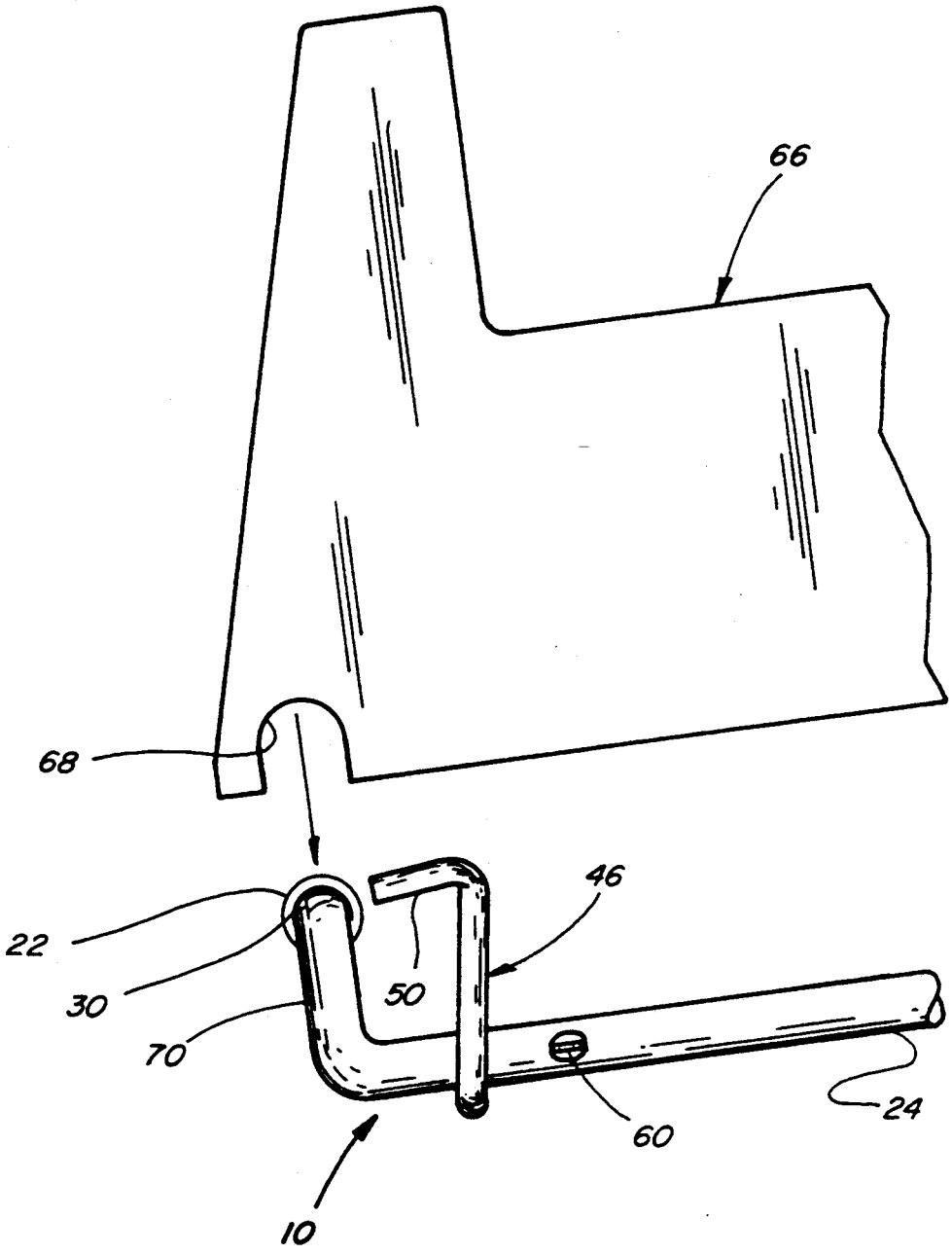
FIG. 8 is a partial side elevational view illustrating the mating relationship between certain product merchandising units and the front wall portion of the present shelf support structure.

It is important to note that the front tubular member 22 as well as its telescoping rod member 30 are positioned and located above the other corresponding cross members 18, 20, 26 and 28. The raised front members 22 and 30 were specifically designed to engage respective slots formed in the front wall portion of many of the product merchandising units manufactured and sold by Applicants' assignee such as the slot 68 associated with the product merchandising unit 66 illustrated in FIG. 8. The depth or height of the slot 68 as well as the height of the upwardly extending rod portion 70 may be correlated to produce a desired shelf orientation when the unit 66 is positioned on the support structure 10 and the slot 68 is engaged with the front support members 22 and 30. For example, such correlation may be that the unit 66, when engaged with the support structure 10, lies in a substantially horizontal position when the support structure 10 is likewise positioned in a substantially horizontal orientation. Other correlations are likewise possible. In any event, engagement of the slot 68 with the front support members 22 and 30 serves as a stop mechanism for preventing fore and aft movement of the unit 66 when such unit is positioned on the support structure 10. This is particularly advantageous when the support structure 10 is positioned in an inclined orientation for gravity feed operations. This also prevents the front portion of unit 66 from sliding into contact with the cooler doors associated with the display cooler 62 during use. Regardless of the correlation between the depth of the slot 68 and the height of the rod portion 70, the rear portion of the support structure 10 can be easily adjusted up or down along the rear upright support members 54 such that the product merchandising unit 66, when engaged therewith, can be positioned in either a substantially flat horizontal orientation or an inclined orientation for gravity feed applications.

The present shelf structure 10 is also easily adaptable for holding and supporting other product merchandising units which do not include slot means 68. In this event, the forward portion of intermediate rod member 32 may be re-designed so as to conform to the forward portion of rod members 16 and 24 as illustrated in dotted outline form at 32A in FIG. 1. This re-configuration of rod member 32 to rod member 32A allows any existing product merchandising unit to be positioned and supported on the support structure 10 such that the front wall portion thereof lies adjacent to and behind the front support members 22 and 30. This provides a relatively flat orientation for any product merchandising unit positioned on the support structure 10 and the elevation of the rear portion of the support structure 10 can be easily adjusted to achieve either a horizontal orientation or an inclined orientation as previously explained. It is also recognized and anticipated that, for certain applications, the front support members 22 and 30 may be located in the same plane as the other cross members 18, 20, 26 and 28.

It is also important to note that the overall dimensions of the support structure 10 as well as the shape and configuration of the various members comprising the support structure 10 such as the side members 16, 24 and 40, the cross members 18–22 and 26–30, the intermediate support member 32, and the hook members 44 and 46 are subject to wide variations and may be sized and shaped into a variety of different sizes and configurations so as to be compatible with the size and shape of the particular product merchandising display device into which the present support structure 10 may be mounted, or to conform with any other space limitation, without impairing the teachings and practice of the present invention. For example, such members may be of a substantially flat shape instead of a rod and tube type construction. In this regard, it is also recognized and anticipated that only some of the plurality of cross members 18–22 and 26–30 may actually telescopingly cooperate with each other to provide the relative movement between the members 12 and 14, and that a wide variety of other interconnection means between the members 12 and 14 are likewise possible and will achieve the desired relative movement between such members to vary the overall width of the structure 10.

Although it is preferred that all of the components comprising the overall support structure 10 be constructed from basic metal wire, rod and/or tube stock, it is recognized that various other acceptable materials of construction including flat type materials are available and could likewise equally be employed to construct the various components of the present device. It is therefore recognized that certain metal alloys, fiberglass, wood and other materials could be utilized in the practice of this invention. The selection of materials should take into account the type of products to be merchandised therefrom as well as their weight and the particular environment where the support structures 10 are to be located. It is also anticipated that the present support structure can be fabricated from coated materials. Materials of this description may consist of metal wire having various shapes and sizes which are formed to the desired configuration. The entire assembly may then be coated with vinyl or other suitable plastic material so that the entire assembly has a pleasing appearance and resists corrosion and scratching. Other suitable coatings are likewise possible.

Thus there has been shown and described several embodiments of a novel adjustable shelf support structure which is mountable within existing shelf and display equipment, including refrigerated coolers, which support structures fulfill all of the objects and advantages sought therefor. Many changes, modifications, variations and other uses and applications of the present constructions will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A shelf support structure adaptable for use with existing product merchandising display equipment comprising first and second relatively movable members, each of said first and second movable members having at least one portion thereof forming one opposed side portion of said support structure and each having a plurality of spaced members arranged transversely to said associated side portion, said plurality of spaced transverse members defining the width of said support structure and the length of said associated side portions defining the depth thereof, at least some of the spaced transverse members associated with each of said plurality of spaced transverse members having cross-sectional shapes adaptable for slidably receiving and engaging each other so as to enable said first and second members to be arranged in telescoping relationship with each other whereby said first and second members can be moved relative to each other to change the overall width of said support structure, each side portion of said first and second members including means for adjusting the effective length thereof so as to change the overall depth of said support structure, said first and second members when engaged with each other foraging an open grid structure capable of both width and depth adjustment to accommodate the varying width and depth dimensions associated with existing product merchandising display equipment.

2. The shelf support structure defined in claim 1 wherein the adjustment means associated with each side portion of said first and second members includes at least one bracket member attached thereto, said bracket member including means for slidably receiving an additional member, said additional member being slidably movable within said bracket member so as to increase the effective length of each of said side portions.

3. The shelf support structure defined in claim 2 including stop means associated with one end portion of each of said additional members, said stop means preventing said additional members from becoming disengaged from said bracket members.

4. The shelf support structure defined in claim 3 wherein said stop means are removable from the one end portion of each of said additional members for allowing said additional members to be removed from said bracket members.

5. The shelf support structure defined in claim 1 wherein one of said plurality of spaced transverse members associated respectively with each of said first and second relatively movable members forms front wall means extending across said support structure between said opposed side portions, said front wall means being positioned and located above the other plurality of spaced transverse members.

6. The shelf support structure defined in claim 1 including means for mounting said structure within existing product merchandising display equipment.

7. The shelf support structure defined in claim 2 wherein the existing product merchandising display equipment includes a plurality of upright support members each having a plurality of vertically spaced attachment means formed therein, said shelf support structure including a plurality of hook members, one hook member being located in the vicinity of each of the respective four corners of said shelf support structure, at least two of said hook members being engageable with the side portions of said first and second members and at least two of said hook members being engageable with said additional members, each of said hook members being slidably movable along at least a portion of the particular member to which it is attached and each including an angularly related portion, each of said angularly related hook portions being engageable with a selected one of the vertically spaced attachment means associated with said upright support members.

8. The shelf support structure defined in claim 7 wherein said hook members are dimensioned so as to enable said shelf support structure to be attached to the upright support members of the existing product merchandising display equipment at any intermediate location therealong in either a substantially flat horizontal position or in an inclined position for gravity feed operations.

9. The shelf support structure defined in claim 7 wherein the opposite end portion of each of said additional members includes stop means for preventing the respective hook members attached thereto from becoming disengaged therefrom.

10. The shelf support structure defined in claim 7 wherein each side portion of said first and second members includes stop means positioned at an intermediate location therealong so as to limit the travel of the respective hook members engaged therewith within a specific range of movement.

11. A support structure for use in combination with product merchandising display equipment wherein the product merchandising display equipment includes a plurality of vertical support members each having a plurality of vertically spaced attachment means associated respectively therewith, said support structure comprising first and second relatively movable members, said first member including at least one rod member forming one opposed side portion of said support structure and a first set of spaced members arranged substantially perpendicular thereto, said second member including at least one rod member forming the other opposed side portion of said support structure and a second plurality of spaced members arranged substantially perpendicular thereto, at least a portion of said first and second plurality of spaced members being engageable with each other such that said first and second members can be moved relative to each other to change the overall distance between the rod members forming the opposed side portions of said support structure, adjustment means engageable with said opposed side rod members for changing the effective length of said opposed side rod members so as to adjust the overall depth of said support structure, and means engageable with said support structure and with the vertical support members of the product merchandising display equipment for mounting said support structure within the product merchandising display equipment.

12. The support structure defined in claim 11 wherein said adjustment means for changing the effective length of each of said opposed side rod members includes means for slidably moving an additional rod member relative to each of said side rod members.

13. The support structure defined in claim 12 wherein said means for mounting said support structure within the product merchandising display equipment includes a plurality of hook members, at least one hook member being located in the vicinity of each of the respective four corners of said support structure, some of said plurality of hook members being engageable with said opposed side rod members and some of said plurality of hook members being engageable with said additional rod members, each of said hook members being slidably movable along at least a portion of the particular rod member to which it is attached and each including an angularly related portion, each of said angularly related hook portions being selectively engageable with one of the vertically spaced attachment means associated with the vertical support members of the product merchandising display equipment.

14. The support structure defined in claim 11 wherein said first plurality of spaced members are substantially tubular in shape and wherein said second plurality of spaced members are shaped so as to be slidably insertable within said first plurality of tubular shaped members.

15. In a product merchandising display unit having a plurality of substantially upright support means associated therewith for supporting a plurality of shelf display areas positioned therewithin, each of said upright support means having a plurality of spaced attachment means associated therewith, the improvement comprising a shelf support structure attachable to said upright support means, said support structure comprising first and second members, each of said first and second members having a rod member forming one opposed side portion of said support structure and each having a plurality of spaced members arranged substantially perpendicular to said associated side rod member, said plurality of spaced members being telescopingly engageable with each other such that said first and second members can be moved relative to each other so as to vary the overall width of said support structure, each of the rod members forming the opposed side portions of said support structure including means for adjusting the effective length of such rod members so as to vary the overall depth of said support structure, and means for attaching said shelf support structure to the upright support means of said product merchandising display unit, said attachment means including a plurality of hook members each having one portion thereof engageable with said shelf support structure and each having another portion thereof engageable with a selected one of the spaced attachment means associated with said upright support means.

16. The improvement defined in claim 15 wherein said plurality of hook members are selectively engageable with said upright support means so as to orient said shelf support structure in either a substantially flat horizontal position or an inclined position for gravity feed operations.

17. A shelf support structure adaptable for use with existing product merchandising display equipment comprising first and second relatively movable members, each of said first and second movable members having at least a portion thereof forming one opposed side portion of said support structure and each having a plurality of spaced members arranged transversely to said associated side portion, at least some of the spaced transverse members associated with one of said first and second movable members having means associated therewith for slidably engaging at least some of the spaced transverse members associated with the other of said first and second movable members so as to enable said first and second members to be moved relative to each other to change the overall distance between the respective portions of said first and second members forming the opposed side portions of said support structure, and means engageable with each side portion of said first and second members for adjusting the effective length thereof so as to change the overall depth of said support structure, said first and second members when engaged with each other forming an open grid structure capable of both width and depth adjustments to accommodate the varying width and depth dimensions associated with existing product merchandising display equipment.

18. The shelf support structure defined in claim 17 including means for mounting said structure within existing product merchandising display equipment.

* * * * *

UNITED STATES PATENT AND TRADEMARK OFFICE

CERTIFICATE OF CORRECTION

PATENT NO. : 5,450,971

DATED : September 19, 1995

INVENTOR(S) : Andrew J. Boron, Donald J. Miller, Jr. and Keith Harbour

It is certified that error appears in the above-indentified patent and that said Letters Patent is hereby corrected as shown below:

Column 8, line 26, "fiat" should be --flat--.

Column 11, line 42, "foraging" should be --forming--.

Signed and Sealed this

Twenty-eighth Day of November 1995

*Attest:*

*Attesting Officer*

Bruce Lehman

BRUCE LEHMAN

*Commissioner of Patents and Trademarks*